United States Patent [19]

Mulcahy et al.

[11] Patent Number: 4,933,005

[45] Date of Patent: Jun. 12, 1990

[54] MAGNETIC CONTROL OF MOLTEN METAL SYSTEMS

[76] Inventors: Joseph A. Mulcahy, 30 Center Street, Brooklin, Ontario, Canada, L0B 1C0; Julian Szekely, 141 Merriam St., Weston, Mass. 02193

[21] Appl. No.: 395,973

[22] Filed: Aug. 21, 1989

[51] Int. Cl.[5] ..... B22D 27/02

[52] U.S. Cl. ..... 75/10.16; 266/234; 164/468

[58] Field of Search ..... 75/46, 50, 10.16, 10.14; 266/234; 164/468

[56] References Cited

U.S. PATENT DOCUMENTS

| | | | |
|---|---|---|---|
| 3,452,973 | 7/1969 | Kawawa et al. | 266/234 |
| 3,790,145 | 2/1974 | Gering | 266/234 |
| 4,565,234 | 1/1986 | Kojima et al. | 164/468 |
| 4,749,025 | 6/1988 | Nonini | 164/468 |

*Primary Examiner*—S. Kastler

*Attorney, Agent, or Firm*—Shoemaker and Mattare, Ltd.

[57] ABSTRACT

A static high intensity magnetic field is applied to electromagnetically-stirred molten metal to minimize turbulence in the molten metal. One application of the invention is to minimize meniscus distortions and/or surface disturbances produced by the electromagnetic stirring at a free surface. Another application is to improve laminar flow in the entrance to horizontal molds.

13 Claims, 2 Drawing Sheets

MAGNETIC CONTROL OF MOLTEN METAL SYSTEMS

FIELD OF INVENTION

The present invention relates to the electromagnetic processing of molten metal systems, in particular the confinement and flow control of agitated molten metal systems.

BACKGROUND TO THE INVENTION

Electromagnetic stirring is a frequently employed process in metals processing operations. Representative examples include induction stirring of the mold region of continuous casters and the induction stirring of ladles in ladle metallurgy operations.

A recently suggested application of electromagnetic stirring is in the field of rheocasting or the casting of composite materials, where intensive stirring is required to impart fluidity to melt-solid suspensions. Intensive agitation is required to reduce the apparent viscosity of such systems.

Electromagnetic stirring generally involves inducing a rotating motion in a melt in a horizontal plane, or, alternatively, a predominantly vertical motion may be induced in the melt through the use of linear stirrers.

Many other stirring possibilities exist, involving different geometries, including the molds of slab, thin slab and bar casters, with the molds having vertical, horizontal or other orientation. Furthermore, the actual stirring to be employed may produce predominantly vertical, horizontal or helical motion. Stirring may be continuous, intermittent or provide alternating directions for the velocity field.

One potential problem with most prior art stirring applications is the fact that, when there exists a free surface, such as exists in continuous casting when the mold region is being stirred and also in ladle metallurgy applications, intensive stirring can distort the meniscus and may produce disturbances or waves on the free surface.

As an example of this problem, when horizontal, rotational flow is being induced in a cylindrical container, a central depression is generated, the depth of which is determined by the expression:

$$h = \frac{w^2}{2g} R^2$$

wherein:

h is the depth of the depression, w is the angular velocity,

R is the radius of the cylinder, and g is the acceleration due to gravity.

The meniscus becomes distorted at the walls due to upward flow of metals and wave formation may occur. Such distortion in the meniscus shape and the formation of waves is highly undesirable in many applications of electromagnetic stirring to continuous casting.

More specifically, when mold powders are being used, which often is the case, free surface disturbances can lead to entrainment of the mold powder in the molten metal and hence the presence of impurities occluded in the finished product.

Intensive metal circulation also may lead to erosion of pouring tubes immersed in the molten metal and through which the molten metal is fed to the mold. In addition, the quite high velocities that may be desirable for certain applications, for example, rheocasting or the production of very fine grain structures, may result in unacceptably large meniscus deformations.

SUMMARY OF INVENTION

The present invention is directed towards improving inducting stirring applications where there exists a free surface, including mold stirring in continuous casting and electromagnetic stirring in ladles or other containers, so as to minimize surface disturbances and distortions in the meniscus. In accordance with the present invention, this result is achieved by applying a static high intensity magnetic field in the region of the free surface. The present invention is applicable also to minimizing liquid metal turbulence, even in the absence of a free surface.

Accordingly, in one aspect of the present invention, there is provided an induction stirring method, which comprises electromagnetically inducing stirring of molten metal with such intensity as normally to induce turbulence in the molten metal, and applying a static magnetic field to the molten metal upstream of the location of the electromagnetic stirring to minimize the turbulence.

One application of the procedure of the present invention is to minimize meniscus distortion and/or surface distortions at a free surface of molten metal being electromagnetically stirred.

By eliminating or at least minimizing the meniscus distortions and/or surface disturbances at the free surface, the problems produced thereby as mentioned above are eliminated or at least minimized.

Another application of the procedure is to minimize turbulence at the entrance to an enclosed mold to which the molten metal is fed and in which electromagnetic stirring is effected. By applying the static magnetic field in this way, an improved laminar flow is obtained, which improves product quality.

The invention is broadly applicable to all electroconductive materials which can be electromagnetically stirred, including metals, such as copper, zinc, lead, iron and aluminum, as well as their alloys, such as steel, and semi-conductive materials, such as silicon and gallium arsenide.

DESCRIPTION OF PREFERRED EMBODIMENT

Figure 1:
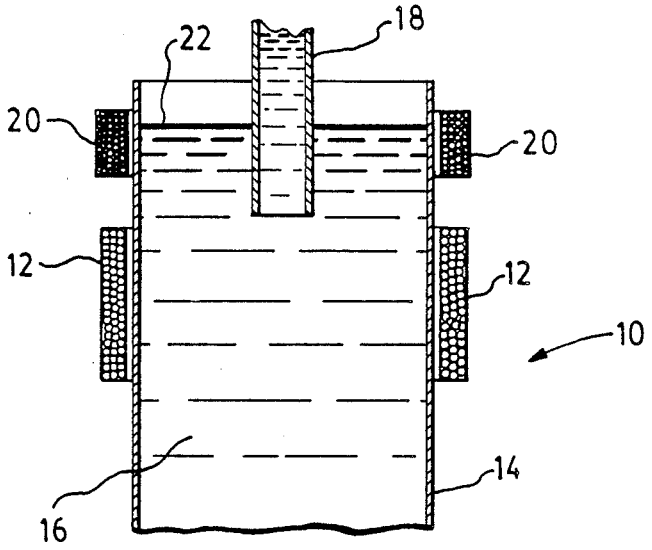
FIG. 1 is a close-up view of the upper portion of a vertical continuous caster provided with stirring coils and constructed in accordance with one embodiment of the invention.

Referring to the drawings, FIG. 1 is an elevational view of the upper portion of a continuous caster 10. A series of induction coils 12 is arranged equally spaced around the periphery of a casting mold 14, so as to induce rotary motion of molten metal 16 in the mold 14 about its axis. A pouring tube 18 is axially located with respect to the molten metal 16 in mold 14 for feeding molten metal thereto.

In accordance with the present invention, d.c. coils 20 are provided at opposite sides of the mold 14 adjacent a free upper surface 22 of the molten metal in the mold 14. The employment of the stirring coils 12 normally causes meniscus distortion and surface disturbances at the free surface 22 of the molten metal 16. In addition to the possibility for occlusion of mold flux provided at the surface 22, the presence of such disturbances can cause excessive erosion of the molten metal pouring tube 18.

The d.c. coils 20 are employed to provide a static magnetic field "at"; the free surface 22 of the molten metal 16 to minimize the formation of the meniscus otherwise induced by the electromagnetic stirrer coils 12. As a result, the problems associated with such meniscus distortions and disturbances, including mold powder occlusion and feed pipe erosions are overcome.

The magnetic field applied by the d.c. coils 20 necessarily depends on the stirring force that is being applied to the molten metal 16. In conventional continuous casting, the stirring field usually is within the range of about 200 to about 800 gauss. Generally, the DC field should be at least as strong as the stirring field and preferably is from about 3 to about 5 times the strength of the stirring fields. Under these conditions, a preferred range of the field produced by the d.c. coils is about 1500 to about 2000 gauss.

One of the attractions of the method of the present invention is the potential for the use of stronger magnetic fields for the electromagnetic stirring, for example, such as is desirable in rheocasting, while still preventing free surface disturbances and other turbulence. In general, a magnetic field of at least about 2000 gauss is employed, preferably from about 2000 to about 5000 gauss.

The d.c. coils 20 may be replaced, if desired, by permanent magnets producing the desired magnetic field. The coils 20 or permanent magnet substitutes are required to be located adjacent the free surface 22 so that the magnetic field is applied across the surface 22 to achieve the "calming"; effect on the molten metal surface 22.

The number of the sources of static magnetic field depends to a large extent on the size of the area over which the magnetic field is to be applied and the intensity of magnetic field required. With a small diameter mold, a single coil 20 or a permanent magnet may be sufficient, while, for larger diameter molds, multiple numbers of static magnetic field sources generally are required, positioned equally spaced around the periphery of the mold or other vessel through which the molten metal is passing.

In the illustrated embodiment, the mold 14 is of circular cross section. However, the principles of the invention are applicable to any cross sectional geometry of vessel through which the molten metal flows while being subjected to electromagnetic stirring.

Figure 3:
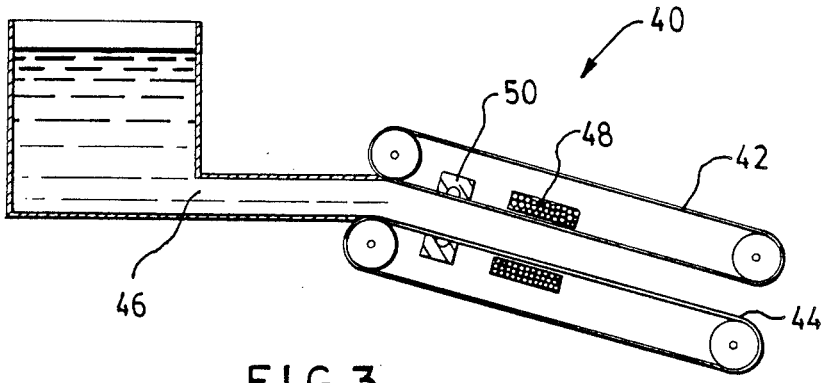
Figure 4:
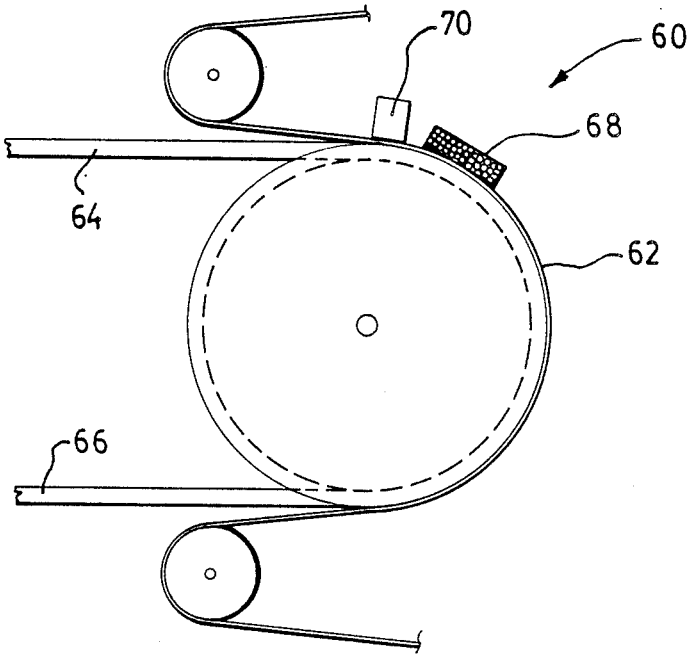
FIG. 4 shows a vertical wheel caster constructed in accordance with a further embodiment of the invention.

FIG. 1 shows the application of the principles of the present invention to an "open-topped" vertical mold where the turbulence at the free metal surface is quietened. As mentioned earlier, the present invention also is applicable to the quietening of the turbulence in a closed mold or similar environment to improve laminar flow. Such application is shown in FIGS. 2 to 4.

Figure 2:
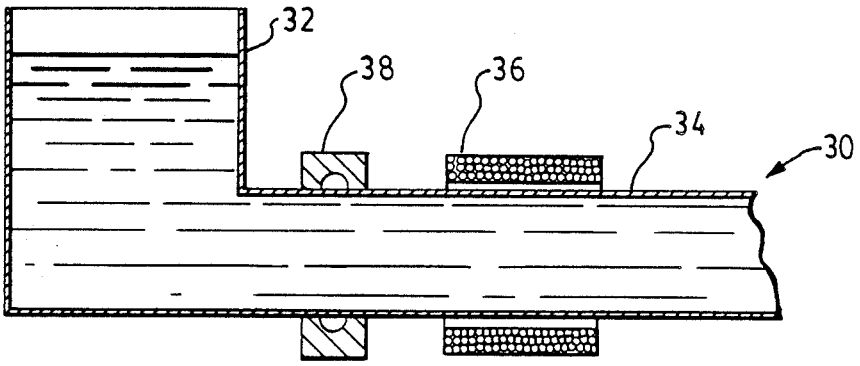
FIGS. 2 and 3 show two forms of horizontal continuous caster constructed in accordance with another embodiment of the invention.

In the embodiment of FIG. 2, a horizontal continuous casting machine 30 is illustrated, particularly for a horizontal slab casting, wherein molten steel from a tundish 32 flows through a horizontally-positioned casting mold 34. The casting mold 34 may have any desired cross sectional shape and dimension consistent with the product desired, which may be a billet, bloom or slab. Similarly to the vertical continuous caster of FIG. 1, induction stirring coils 36 are provided adjacent the casting mold 34 to effect stirring of the molten metal in the mold.

The molten metal from the tundish 32 generally flows into the casting mold 34 at a rate which causes turbulence and non-laminar flow at the entrance to the casting mold 34, which may adversely effect the quality of the product produced thereby.

D.C. coils or permanent magnets 36 are provided adjacent the location of inflow of molten steel from the tundish 32 to the casting mold 34, so as to minimize the turbulence and non-laminar flow caused by the incoming metal stream. Such magnets 36 also may be provided in conjunction with the tundish 32, if electromagnetic stirring is applied thereto to stabilize the meniscus at the free surface of the molten metal in the tundish, in analogous manner to that described above with respect to FIG. 1.

The embodiment of FIG. 3 shows an inclined twin belt slab caster 40 employing upper and lower continuous belts 42 and 44 which are downwardly inclined and into which a horizontal strand of molten metal 46 is fed. Again the flow of the molten metal into the caster produces turbulence and non-laminar flow adjacent the location of introduction of molten metal into the caster. Induction stirring coils 48 are provided adjacent the belts 42 and 44 to effect stirring of the molten metal. D.C. coils or permanent magnets 50 are provided adjacent the entrance to the mold 40 to minimize disturbances caused by the incoming molten metal.

In the illustrated embodiment, a two-pole magnetic coil 50 is employed, with the second pole tending to minimize electromagnetic motion induced by the downstream stirrer.

In FIG. 4, a vertical wheel caster 60 is illustrated having a channel casting mold 62 provided on the periphery of a vertical wheel and into which molten metal 64 flows and from which a shape corresponding in cross-section to the channel in the mold 62 is removed. An electromagnetic stirrer 68 is provided adjacent the mold 62 to effect stirring of the molten metal in the channel. A set of d.c. coils or permanent magnets 70 may be provided adjacent the channel in the mold 62 to minimize disturbances caused by the incoming molten metal stream 64 and to minimize electromagnetic motion induced by the downstream stirrer.

SUMMARY OF DISCLOSURE

In summary of this disclosure, the present invention provides a novel method of minimizing turbulence in molten steel which results when electromagnetic stirring is carried out with respect to the molten steel, by employing a static magnetic field adjacent the location of such turbulence. Modifications are possible within the scope of this invention.

What we claim is:

1. An induction stirring method, which comprises:

electromagnetically inducing stirring of molten metal with such intensity as normally to induce turbulence in the molten metal, and applying a static magnetic field to the molten metal at a location upstream of the location of said electromagnetic stirring of an intensity at least sufficient to minimize said turbulence in said location.

2. The method of claim 1 wherein the static magnetic field is at least as strong as the magnetic field employed to effect the electromagnetic stirring.

3. The method of claim 2 wherein said static electric field is about 3 to about 5 times as strong as the magnetic field employed to effect the electromagnetic stirring.

4. The method of claim 1 wherein the magnetic field employed to effect the electromagnetic stirring has a strength of about 200 to about 800 gauss and the static magnetic field has a strength of about 1500 to about 3000 gauss.

5. The method of claim 1 wherein the static magnetic field has a strength of at least 2000 gauss.

6. The method of claim 5 wherein the static magnetic field has a strength from about 2000 to about 5000 gauss.

7. The method of claim 1 wherein said molten metal has a free surface, said electromagnetic stirring is such an intensity to induce meniscus distortion or surface disturbances at the free surface, and the static magnetic field is applied across the free surface with an intensity at least sufficient to minimize said meniscus distortions or surface disturbances at the free surface.

8. The method of claim 7 wherein the molten metal is confined in a vertical continuous casting mold into which the molten metal is fed by a pouring tube and wherein the free surface is located adjacent the top of the vertical mold.

9. The method of claim 1 wherein said molten metal is fed from a source thereof into a casting mold at a feed rate to result in turbulence and non-laminar flow adjacent the entrance to said casting mold and upstream of the location of said electromagnetic stirring, and the static magnetic field is applied to the molten metal adjacent said entrance to the mold with an intensity at least sufficient to minimize said turbulence and non-laminar flow.

10. The method of claim 9 wherein said casting mold is a horizontal slab caster and said source of molten metal is contained in a tundish in fluid flow communication with said horizontal slab caster.

11. The method of claim 9 wherein said casting mold is an inclined twin belt caster and said source of molten metal is contained in a flow channel in fluid flow communication with said twin belt caster.

12. The method of claim 11 wherein said static magnetic field is applied by a two pole magnet.

13. The method of claim 9 wherein said casting mold is a vertical wheel caster.

* * * * *